United States Patent [19]

Luttrell et al.

[11] Patent Number: 5,026,073

[45] Date of Patent: Jun. 25, 1991

[54] AERIAL GUNNERY TARGET

[75] Inventors: Clyde K. Luttrell, New Market; Donald T. Moore, Huntsville, both of Ala.

[73] Assignee: Teledyne Industries, Inc., Los Angeles, Calif.

[21] Appl. No.: 343,438

[22] Filed: Apr. 26, 1989

[51] Int. Cl.[5] ..... F41J 9/10

[52] U.S. Cl. ..... 273/360; 244/1 TD

[58] Field of Search ..... 273/360, 361; 244/1 TD

[56] References Cited

U.S. PATENT DOCUMENTS

| | | |
|---|---|---|
| 1,860,982 | 5/1932 | Binnie . |
| 1,901,885 | 3/1933 | Du Pont . |
| 1,974,039 | 9/1934 | Bohannon et al. . |
| 2,011,202 | 8/1935 | Satterlee . |
| 2,035,038 | 3/1936 | Young . |

(List continued on next page.)

FOREIGN PATENT DOCUMENTS

| | | |
|---|---|---|
| 561830 | 11/1957 | Belgium . |
| 0183866 | 4/1984 | European Pat. Off. . |
| 0124785 | 4/1985 | European Pat. Off. . |
| 2602432 | 7/1977 | Fed. Rep. of Germany . |
| 2603061 | 8/1977 | Fed. Rep. of Germany . |
| 2604929 | 8/1977 | Fed. Rep. of Germany . |
| 2613953 | 10/1977 | Fed. Rep. of Germany . |
| 2850217 | 4/1980 | Fed. Rep. of Germany . |
| 3005611 | 8/1981 | Fed. Rep. of Germany . |
| 496230 | 7/1919 | France . |
| 783489 | 4/1935 | France . |
| 865970 | 2/1940 | France . |
| 865109 | 5/1941 | France . |
| 523054 | 10/1953 | France . |
| 1570025 | 4/1969 | France . |
| 7500687A | 1/1975 | Sweden . |
| 590448 | 9/1977 | Switzerland . |
| 435393 | 9/1935 | United Kingdom . |
| 456076 | 11/1936 | United Kingdom . |
| 1448036 | 9/1976 | United Kingdom . |
| 1551904 | 9/1979 | United Kingdom . |
| 2034267B | 11/1982 | United Kingdom . |
| 2122964B | 9/1985 | United Kingdom . |

OTHER PUBLICATIONS

Teledyne Brown Engineering brochure "A/A37U-33 Aerial Gunnery Target System".

Teledyne Brown Engineering brochure "A/A37U-36 Aerial Gunnery Target System".

Marquardt Company brochure "The Model MTR-101 Aerial Target Launch and Recovery Tow Reel".

Hayes Corporation "Haynes Universal Tow Target System".

1978 Technical Report ADTC-TR-78-47, "Prototype Aerial Gunnery Tow Target (AGTT) Vehicle DT&E.-/OT&E (Cord Target)".

Abstract for U.K. Patent No. 1,298,753.

Abstract of U.K. Patent No. 1,353,338.

Abstract of U.K. Patent No. 1,359,797.

Abstract of U.K. Patent No. 1,485,354.

Abstract of European Patent Application Nos. 184,564-A and 140.

*Primary Examiner*—William H. Grieb

[57] ABSTRACT

An aerial gunnery target which is towed behind a towing aircraft. The gunnery target includes an extension device that separates a forebody assembly from a visual augmenter. The target also includes a vented inflator positioned at the foreward end of the visual augmenter. The vented inflator maintains the front end of the visual augmenter open during towing. The visual augmenter is generally cylindrical in shape with an open aft end and an adjustment device for varying the size of the aft opening. In addition, the visual body is comprised of a mesh netting which preferably includes a plurality of interconnected strands joined together to form a plurality of diamond shaped openings. The interconnected strands are each formed of a plurality of knitted threads and the strands are preferably joined together by knitting some or all of threads of one strand with some or all of the threads of an interconnecting strand.

58 Claims, 15 Drawing Sheets

U.S. PATENT DOCUMENTS 2,095,350 10/1937 Soule .
2,122,766 7/1937 Wiemer .
2,153,562 4/1939 Hovgard .
2,153,924 4/1939 Haines .
2,238,875 4/1941 Manson .
2,238,876 4/1941 Manson ..... 273/360
2,270,884 1/1942 Manson .
2,342,651 2/1944 Dircksen .
2,402,156 5/1944 Griesinger .
2,486,999 11/1950 Tapp .
2,523,738 9/1950 Trimbach .
2,538,719 6/1951 Wing Shee et al. .
2,731,046 10/1951 Bachner .
2,751,167 6/1956 Hopper et al. .
2,807,287 9/1957 Frey .
2,907,095 10/1959 Frey ..... 273/360 X
3,000,634 9/1961 South .
3,135,511 6/1964 Norman et al. .
4,205,848 6/1980 Smith et al. .
4,496,159 1/1985 Dugan et al. .
4,624,648 11/1986 Waters .

AERIAL GUNNERY TARGET

BACKGROUND OF THE INVENTION

1. Field of the Invention

The field of this invention lies within the target and gunnery art. In particular, it lies within the specific field of aerial targets that are towed behind an aircraft.

2. Description of Related Art

To improve the shooting and pursuit skills of aircraft pilots, various types of targets have been developed which are towed behind a towing aircraft. Some of the earlier target constructions included elongated fabric panels or banners such as those disclosed in U.S. Pat. Nos. 2,731,046 and 2,807,287. These targets included woven panels attached to a bridle assembly which, in turn, was attached to a long cable secured to a towing aircraft. Alternate prior art forms of tow targets include those found in U.S. Pat. Nos. 2,342,651 and 3,000,634 which feature one or more cylindrical sleeves being dragged behind a tow aircraft. Such targets have proven to be susceptible to flagging and oscillation when dragged a high speeds.

U.S. Pat. No. 4,205,848 discloses a banner proposed for use as an aerial gunnery target which includes a plurality of single strands extending between forward and aft frame structures. This type of prior art target is described as avoiding the prior art problems of flagging and oscillating at high speeds due to the elimination of transmitted forces between the individual strands extending along the length of the target.

Nonetheless, single strands also tend to whip and flag and snap in a manner similar to a whip cracking. This whipping action tends to break the ends of the strands thus shortening the length of the augmenter. Also, the use of individualized strands creates a problem of target survivability after repeated hits by the pursuing plane. Once the individualized strands are hit they tend to freely flow about thus degrading the visual acuity of the target and its performance. Moreover, the positioning of the radar or scoring device close to the forward end of the target makes the device susceptible to destruction due to hits by the pursuing aircraft.

The various visual augmenters such as the banners, sleeves, and interconnected strands discussed above, have also presented the problem of environmental impact. For those visual augmenters which are released before landing of the towing aircraft, there lies the possibility of the visual augmenter dropping into a body of water. This is especially true for the lighter banners which are more apt to be influenced by wind currents. The visual augmenters which fall into a body of water and are formed of relatively buoyant material such as polypropelene present a problem to fishermen and the like in that the visual augmenters tend to tangle up in the netting used by fishermen and the propellers of both commercial and recreation boats. Prior art attempts to solve this problem have included the positioning of weights on the forward end of the visual augmenter. However, even with the weights attached to the forward end of the visual augmenter, portions of the visual augmenter tend to float upwardly towards the surface of the water thereby causing even a greater hazard due to difficulty in spotting the augmenters.

In addition, the visual augmenters of the prior art were prone to be difficult to visually detect due to a lack of visual acuity. This problem in visual detection being especially true for the individual strand configuration of the prior art as often the individual strands bellow outwardly decreasing contrast between the augmenter and the environmental background.

SUMMARY OF THE INVENTION

The present invention, among other things, presents a solution to the aforementioned problems associated with the prior art. In so doing, the present invention provides for the visual augmenter to be spaced well away from the forebody assembly carrying the radar or scoring device. To achieve this spacing, an extension device is utilized which has a front end attached to the rear end of a forebody assembly and a rear end attached to the visual augmenter. Hence, the extension device places the forebody assembly in a position which is less likely to be subjected to hits by pursuing aircraft.

The extension device includes one or more riser lines extending either from a frame or swivel connection attached to the forebody assembly. A plurality of suspension lines extend from the end of each of the riser lines. The suspension lines extend outwardly away from the riser lines and are attached to a vented inflater which is attached to the forefront of the visual augmenter.

In the prior art systems referred to, the visual augmenter was connected to a frame structure which gave the front, open end of the visual augmenter the desired shape. This feature of using the frame structure attached to the forebody is not available when utilizing the present invention's flexible extension device which extends far from the frame. In other words, without a frame structure connected directly to the forward end of the visual augmenter, there exists the possibility of the visual augmenter losing its shape at the forward end.

The vented inflater of the present invention avoids this problem by creating the aerodynamic forces necessary to keep the forward end of a cylindrical type visual augmenter open and in an inflated condition. The vented inflater includes a forward hoop and a rearward hoop joined together by a plurality of flexible panels connected between the forward and rearward hoops. The panels are spaced from one another along the periphery of each of the hoops so as to create air vents between adjacent panels. The panels are also preferably connected to the hoops in a manner which prevents slippage of the panels along the hoop. Also, the forward hoop is larger than the rearward hoop such that when the forward and rearward hoops are tensioned the panels form a frusto conical rim at the forward end of the visual augmenter. The vented inflater thus acts to maintain the forward end of the visual augmenter in an open position.

The visual augmenter is generally cylindrical with an open front end and an open aft end which includes an adjusting device that enables the size of the aft opening to be adjusted. This adjustment feature allows for manipulation of the drag created by the visual augmenter. For situations in which the visual augmenter is to be towed at high speeds, it is preferable that the adjusting device create a large opening at the aft end of the visual augmenter. If lower speeds are anticipated then the adjustment device is preferably manipulated to create less of an opening at the aft end.

The visual augmenter is formed of mesh netting that is comprised of a plurality of strands which intersect one another to form a plurality of longitudinally extending diamond shaped openings. The strands are comprised of knitted threads and at the point of intersection of each strand some or all of the knitted threads (forming each strand) are knitted together so as to create the diamond shaped mesh netting. The arrangement of the inter-connected strands forming the mesh netting tends to reduce the drag of the visual augmenter. This reduced drag is due in part to the compression of the interconnecting strands caused by the wind forces acting on the visual augmenter. The mesh netting also tends to improve visual acuity by maintaining a compacted condition rather than a bellowing configuration as experienced in the prior art.

The mesh netting also increases the useful life of the visual augmenter even after repeated hits. In the event that a hit tends to puncture a hole or sever a strand in the mesh netting there is no adverse affect on the netting which surrounds the point of impact and holds the device together. The visual augmenter of the present invention is also not as susceptible to floating when material such as nylon is used as the threads for knitting the individual strands that are joined together to form the mesh netting. The mesh netting also tends to become entangled along its entire length with the various elements lying on the underwater surface. The use of lead weights further ensures that the visual augmenter will not easily drift with the wind currents and will remain on the bottom of a body of water into which the visual augmenter drops.

BRIEF DESCRIPTION OF THE DRAWINGS

The present invention will be more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
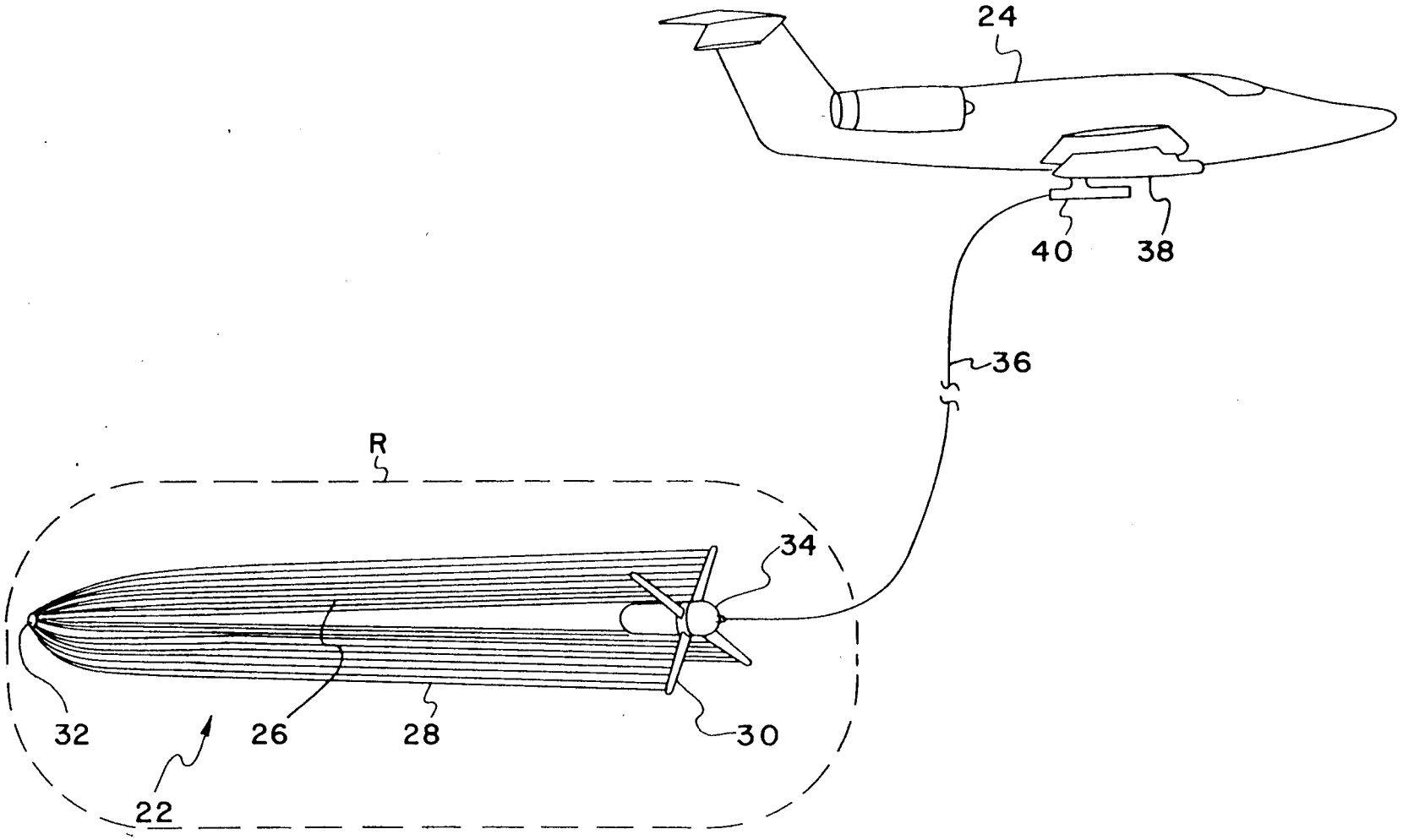
FIG. 1 PRIOR ART
FIG. 1 is a side view of a prior art aerial gunnery target being towed by a towing aircraft.

FIG. 1 shows a prior art aerial gunnery target 22 being towed by towing aircraft 24. Aerial gunnery target 22 includes visual augmenter 26 formed of a plurality of individual strands 28 which are connected to the branches of frame 30. A plurality of the individual strands are arranged in series along each of the branches of frame 30 and extend rearwardly to a point of connection made possible by cap 32. Radar detection device 34 is positioned at the center of frame 30 and creates radar zone R. A pursuing aircraft (not shown) pursues the usually brightly colored visual augmenter 22 and attempts to shoot within zone R while preferably avoiding direct hits to visual augmenter 22 and the other components of visual augmenter 22. Scoring is achieved electronically by determining the position and number of shots passing through the radar zone R. Radar device 34 is attached at its forward end to tow line 36 which is attached to reeling mechanism 38. Tow line 36 usually extends to about 2,000 feet behind the towing aircraft. During take-off, aerial gunnery target 22 is stored in canister 40 and at some point during flight canister 40 is opened and aerial gunnery target 22 is deployed.

Figure 2:
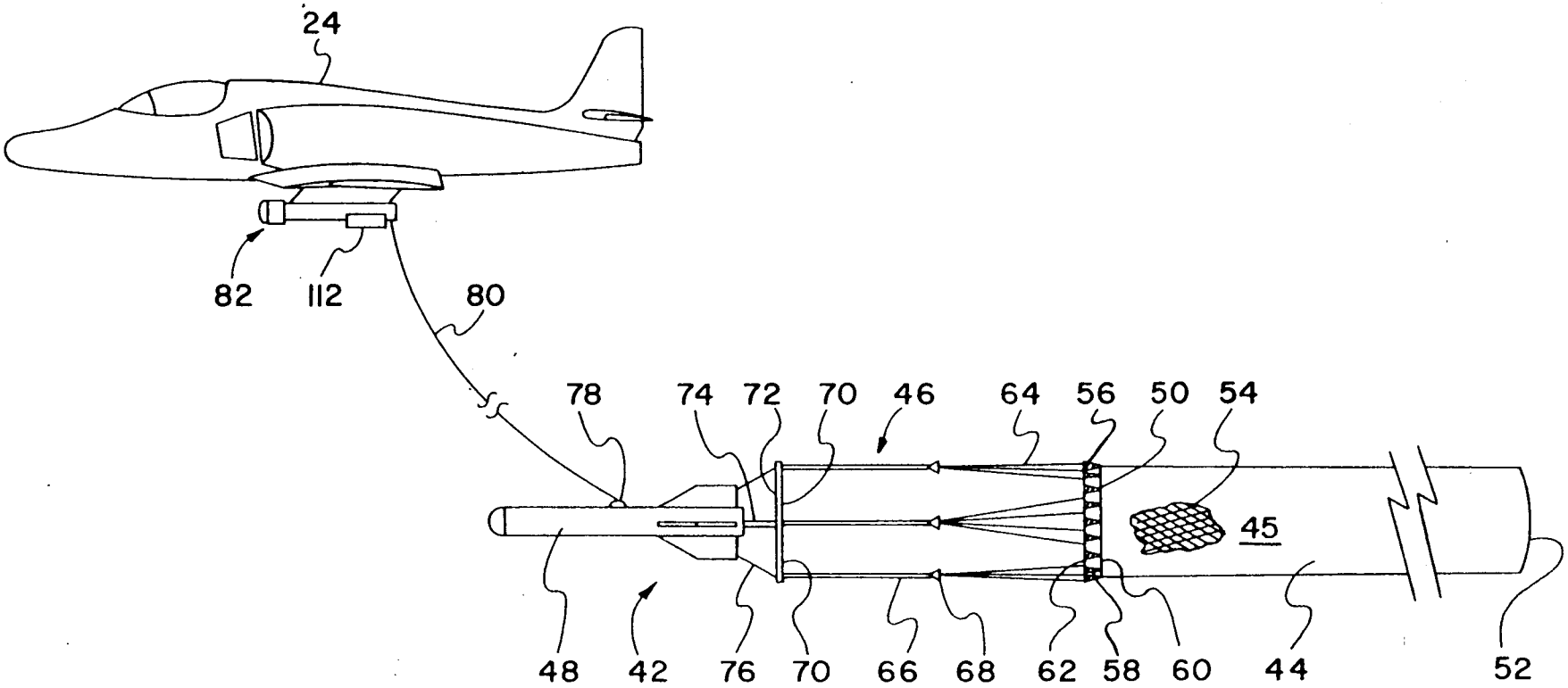
FIG. 2 is a side view of an embodiment of the present invention being towed by a towing aircraft.

FIG. 2 shows a preferred embodiment of the present invention which includes aerial gunnery target 42 comprising a visual augmenter 44, vented inflater 56, extension device 46 and forebody assembly 48. Visual augmenter 44 is preferably cylindrical in shape having an open forward end 50 and a completely open or partially open aft end 52. A length of about 16 feet and an external diameter of 30 inches has proven satisfactory for the purposes of this invention. Visual augmenter 44 is preferably formed of meshed netting 54, the details of which are discussed hereafter.

At the forefront of visual augmenter 44 is connected vented inflater 56 which includes a plurality of spaced flexible panels 58 attached between forward hoop 62 and aft hoop 60. Suspension lines 64 are attached at one end to forward hoop 62 and at their other end to riser lines 66. Suspension lines 64 preferably are in sets of four that diverge outwardly from fixation point 68 which coincides with the rearward end of each of the riser lines 66. The rearwardmost ends of suspension lines 64 are spaced radially around forward hoop 62 and in between panels 58. The connection of the suspension lines 64 to hoop 62 is preferably such that suspension lines 64 retain their position without sliding along hoop 62. The forward end of each of riser lines 66 are connected to the extremities of branches 70 forming part of frame 72. Shaft 74 is attached at the locus of frame 72 and to the rear end of forebody assembly 48. For added stability, bracing members 76 extend between branches 70 and the rear end of forebody assembly 48.

Forebody assembly 48 includes tow line connector 78 to which tow line 80 connects. The opposite end of tow line 80 is attached to reeling device 82 positioned either on the wing or the fuselage of towing aircraft 24.

Figure 3:
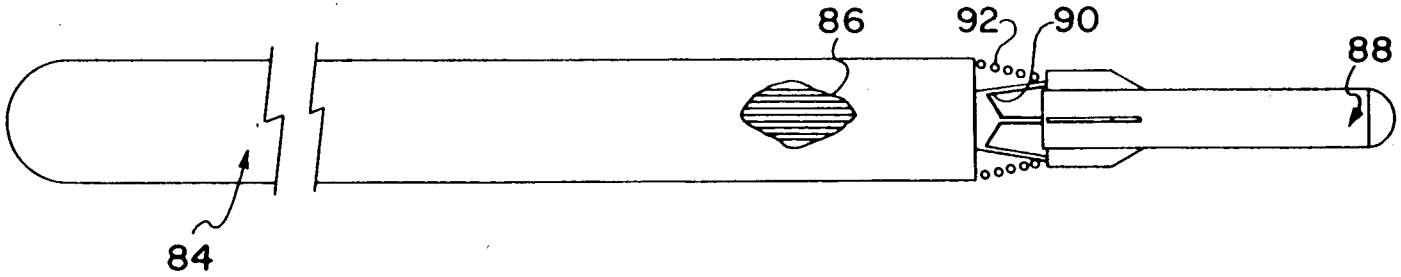
FIG. 3 PRIOR ART
FIG. 3 is a side view of a prior art aerial gunnery target.

FIG. 3 shows another prior art aerial gunnery target having visual augmenter 84 comprised of individual strands 86 similar to those found in FIG. 1. Forebody assembly 88 includes frame 90 and braces 92 which are in direct contact with the forward end of visual augmenter 84. Frame 90 acts to maintain the forward end of visual augmenter 84 in an open position.

Figure 4:
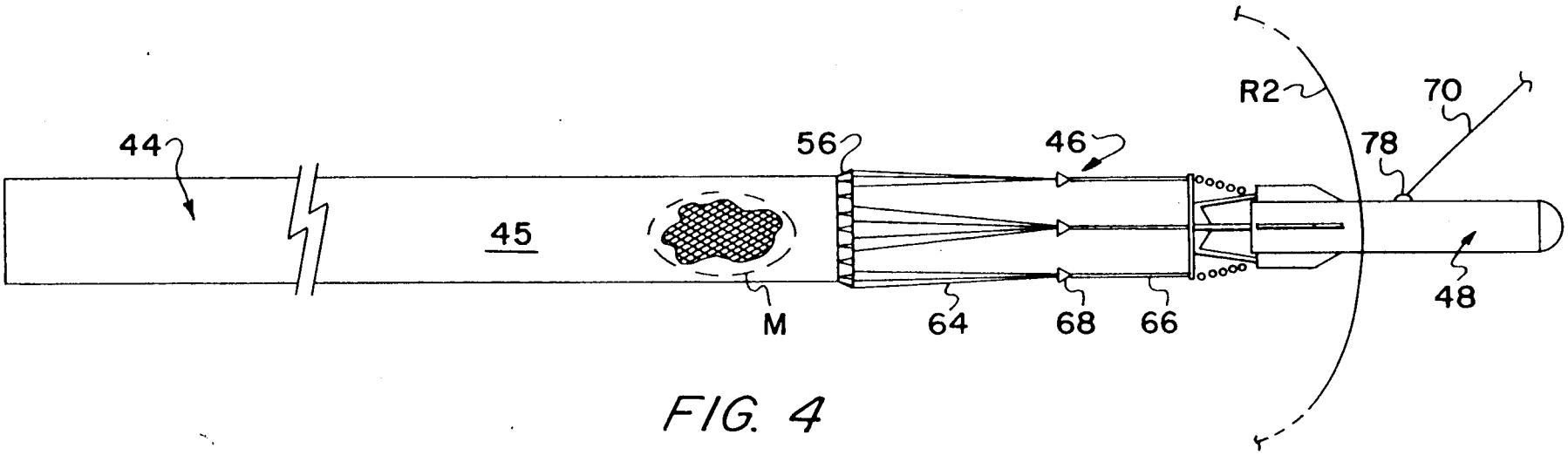
FIG. 4 is a side view of an embodiment of the present invention.
Figure 5:
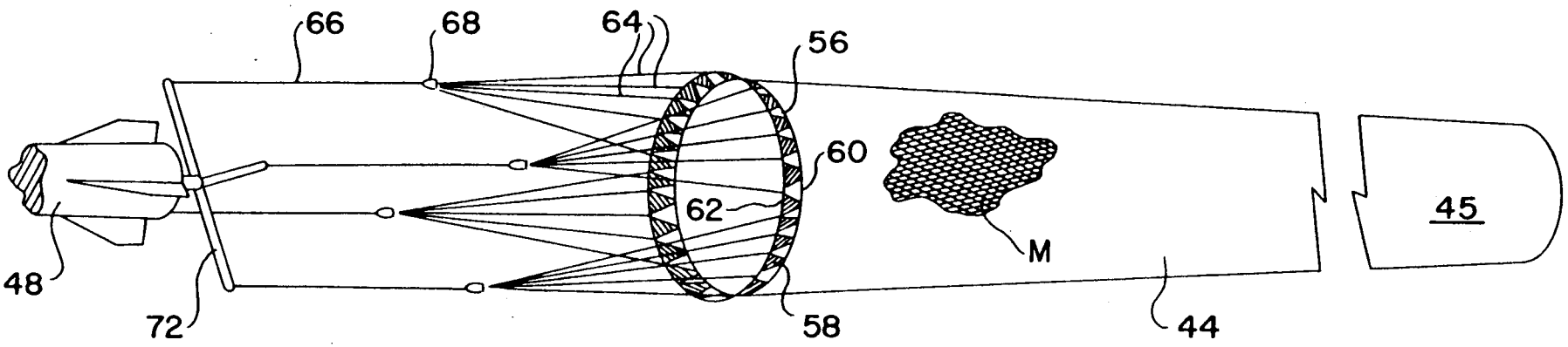
FIG. 5 is a perspective, partially cut-away view of the embodiment shown in FIG. 4.

FIGS. 4 and 5 further illustrate the visual augmenter of the present invention shown being towed in FIG. 2. Forebody assembly 48 includes radar capability which allows for radar zone R2 (partially shown) to be set up for scoring purposes.

Figure 6:
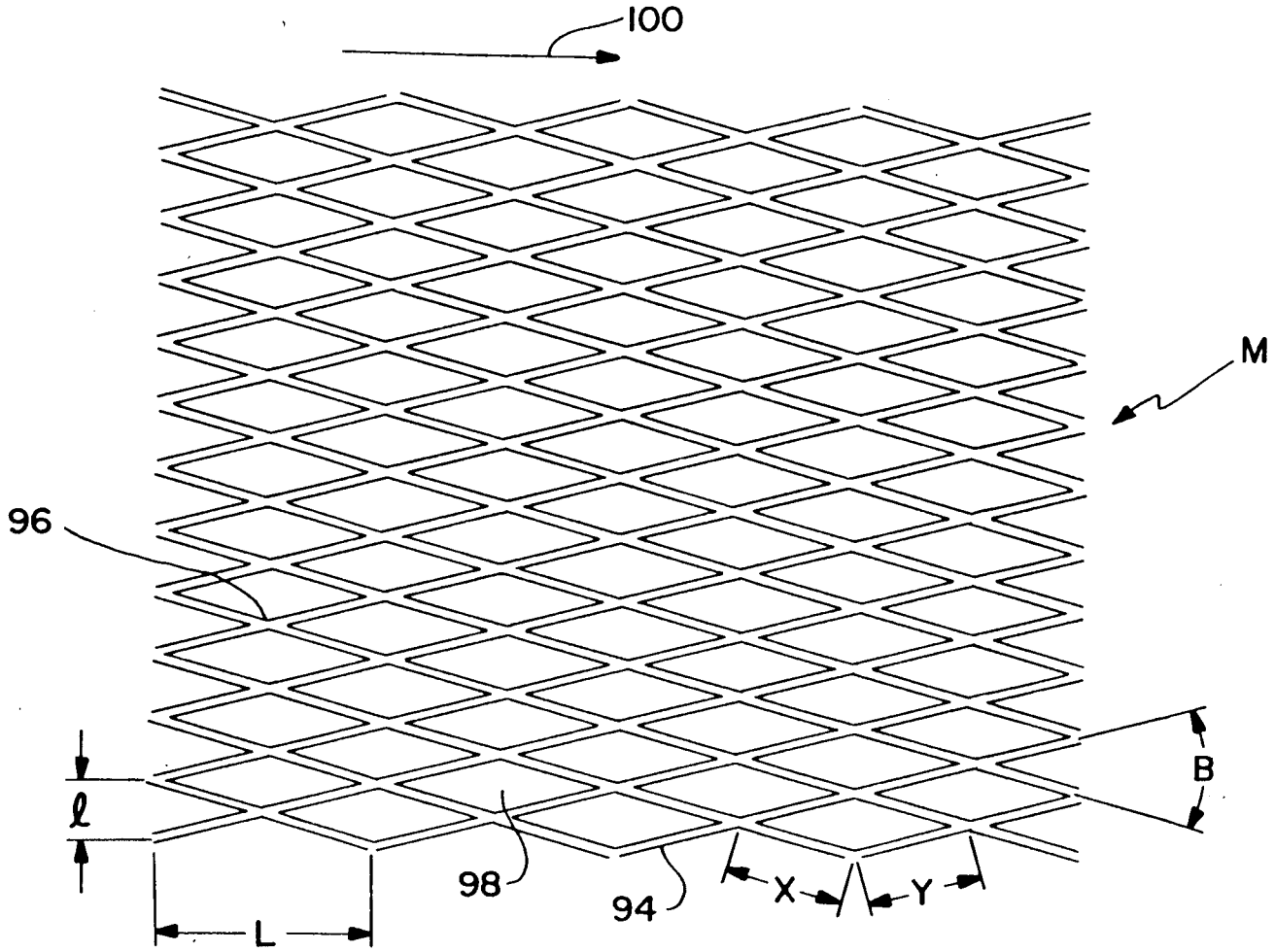
FIG. 6 is a close-up of the mesh netting forming the visual augmenter.

Visual augmenter 44 includes mesh netting M, only a portion of which is shown in detail for draftman's convenience. FIG. 6 shows in greater detail the arrangement of mesh netting M. Mesh netting M is formed of a plurality of interconnecting strands 94. Each of the strands 94 are formed of a plurality of knitted threads preferably comprised of nylon although other materials such as, but not limited to, cotton, polypropylene, polyethylene, or rayon might also be relied upon. At the points of intersection 96 of pairs of strands 94, the individual strands 94 are connected together by way of a knitting process which knits certain of the threads making up one of the two intersecting strands 94 with certain threads of the other interconnected strand 94. The individual threads which are knitted together to form strands 94 are preferably made from 1890 denier nylon thread. Various other ways of joining strands 94 together are also contemplated. For example, strands 94 can be joined together by knotting one strand to the other at their point of intersection. A knitted connection is, however, more preferable as it places less stress on the individual threads.

Strands 94 forming mesh netting M intersect one another at angle $\beta$ which is preferably about 30° so as to create a plurality of diamond shaped openings 98. The longitudinal apex-to-apex length L of each diamond is preferably within a range of about 1.22 to 1.28 inches or about 1¼ inches when mesh netting M is in a collapsed state (i.e., when length X and length Y are essentially planar). In addition, the lateral apex-to-apex length l of each diamond when mesh netting M is in an untensioned state is preferably within a range of about 0.320 to 0.340 of an inch and more preferably about ⅓ of an inch. Nylon diamond mesh netting suitable for the purposes of the present invention is a product of Blue Mountain Industries located in Blue Mountain, Ala. The netting sold by Blue Mountain Industries is referred to as "1¼ inch strength No. 189 knotless nylon netting".

The use of a plurality of knitted threads to form the individual strands and the joining of the strands by a knitting process to form mesh netting M, also provides a advantage with respect to reducing drag. Air flowing along the length of the visual augmenter causes the augmenter to assume a tensioned or stretched state. While in a tensioned state the individual threads of strands 94 compress together, thus decreasing the surface area in contact with the on rushing air stream. In addition, the arrangement of the interconnected strands of mesh netting M, with the diamond shaped openings, leads to one strand drawing an adjacent strand both rearwardly and closer to itself. This arrangement tends to compress the entire body of augmenter 44 inwardly thereby lessening the degree of drag caused by the visual augmenter. Furthermore, the angular orientation of the rearwardly extending strands, with respect to the on rushing air stream, is such that as the augmenter stretches further rearwardly at increased speeds the individual strands 94 tend to assume a position more and more in line with the direction of the on rushing air. This feature enables the augmenter to inherently adjust the degree of drag with increases in tow speed. Direction arrow 100 illustrates the direction of the air as it passe along the length of visual augmenter 44.

FIG. 5 shows vented inflater 56 in an inflated condition. In this condition, vented inflater 56 provides the necessary tension in hoops 60, 62 to form an inlet for a highly porous visual body such as visual body 45 formed of mesh netting M. Vented inflater 56 also performs the function of obtaining and maintaining a cylindrical shape in the visual augmenter by utilizing the local airstream as the energy source.

Figure 5A:
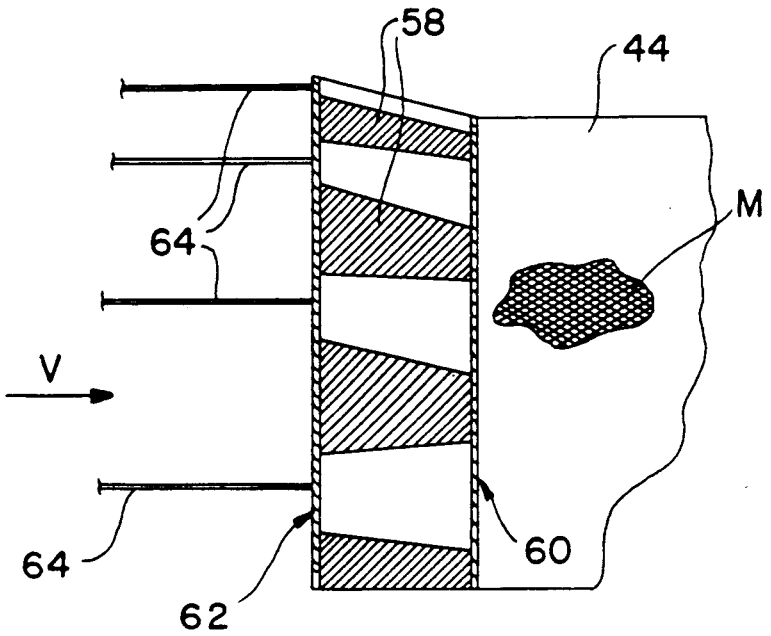
FIG. 5A and 5B are partially cut-away views of the vented inflater shown in FIG. 5.
Figure 5B:
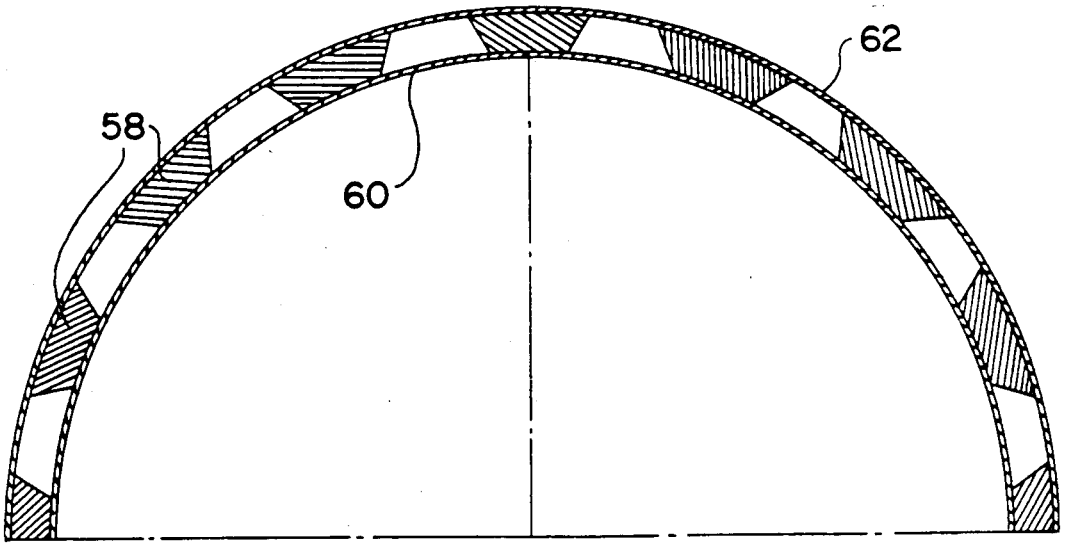

As more fully illustrated in FIGS. 5A and 5B, vented inflater 56 includes a number of panels 58 attached to forward hoop 62 and aft hoop 60. Hoops 60 and 62 are preferably formed of a flexible cable comprised of a material such as nylon. In a preferred embodiment the cable is made up of a plurality of braided nylon fibers which when combined provide a cable having a cross-sectional diameter between about 3/16 of an inch to ¼ of an inch. A diameter for hoops 60 and 62 which is suitable for the purpose of the invention is about 32.6±0.5 and 30.0±0.5 inches, respectively. Hoops 60, 62 are also preferably formed in circular or ring-like fashion. The diameter of forward hoop 62 is larger than the diameter of aft hoop 60 by an amount which causes panels 58 to assume an angle of attack that preferably falls within a range of about 12 to 18 degrees and more preferably is approximately 15° relative to the direction of the local airflow. Various other angles would also be possible depending on the variables involved such as anticipated towing speeds, hoop dimensions, etc. In achieving a 15° angle of attack, forward hoop 62 would preferably have a diameter which is larger than that of aft hoop 60 by a ratio of about 1.087 to 1.0.

The positioning of panels 58 at an angle of attack of about 15° (see FIG. 11) provides sufficient hoop tension (brought about by aerodynamic forces acting on the panels) to keep the forward end of a cylindrical visual augmenter open and thus enable the visual augmenter to remain in an inflated condition. Furthermore, a 15° angle of attack provides sufficient aerodynamic loading to provide the required hoop tension while at the same time minimizing the drag or force in the actual direction of the visual augmenter.

In a preferred embodiment vented inflater 56 includes 16 truncated triangular shaped panels 58. Panels 58 are uniformly positioned with space between each panel and attached to hoops 60, 62 to provide a porosity ratio (panel area/total area) of about 0.5 for the inflater and more preferably about 0.484.

Figure 7A:
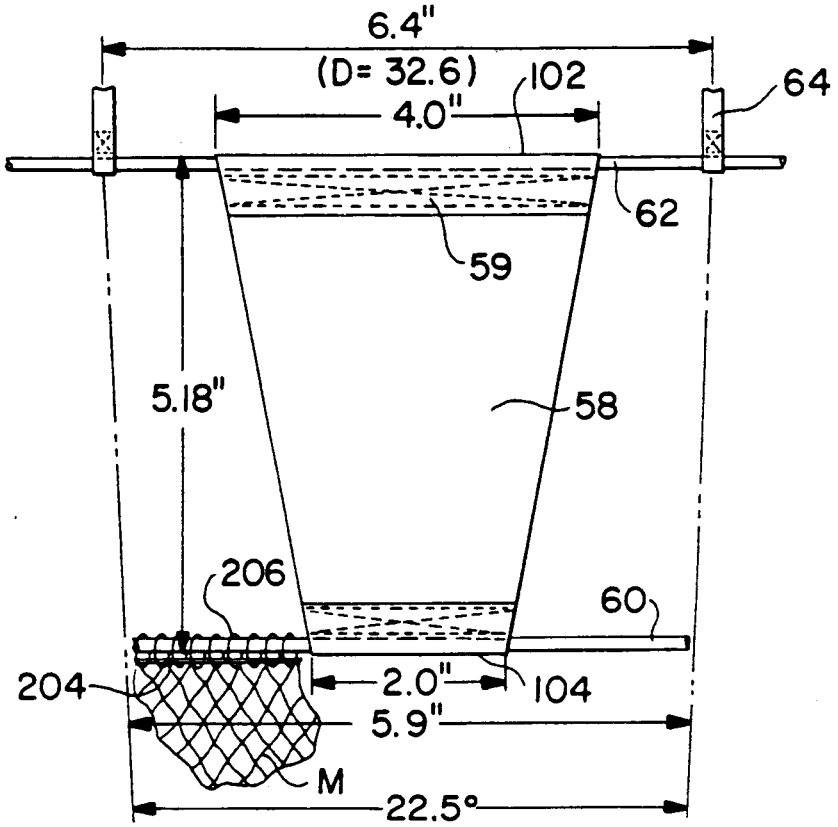
FIG. 7 is a planar view of one of the panels forming the vented inflater shown in FIGS. 5A and 5B.
FIG. 7B shows a cross-sectional side view of a panel and the manner in which the panel is connected to the hoops.
FIG. 7C shows a cross-sectional cut-away view of material forming the vented inflater panels.

FIG. 7 shows the finished flat pattern for a preferred embodiment, as well as the spatial location relative to 1/16 of the area of vented inflater 56, which is equivalent to a 22.5 degree segment of the inflater. Each truncated panel 58 has its forward edge looped over and sewn or fastened to form a passageway for accepting forward hoop cable 62. After cable 62 has been inserted through the loops of panels 58, each panel is positioned with an equal separation space which, with a 32.6 inch diameter forward hoop, proves to be about 2.4 inches. The ends of the cable for hoop 62 are then securely fastened together to form the final configuration of hoop 62. Similarly, the cable for aft hoop 60 is inserted through loops formed in the aft end of each panel with equal separation spaces of about 3.9 inches and the ends of the cable forming aft hoop 60 are joined to form the final configuration of aft hoop 60.

Figure 7B:
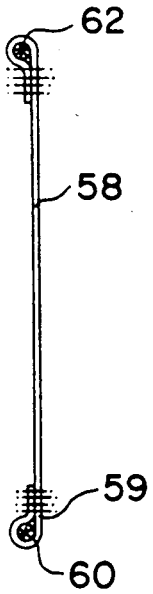

FIG. 7B illustrates the manner in which the forward and rearward ends of panels 58 are looped about forward and aft hoops 60,62. A box-stitching or the like is provided which creates a snug connection between hoops 60, 62 and the looped portions of panels 58. In this way, panels 58 do not shift in position with respect to hoops 60 62. Further contemplated methods for ensuring that panels 58 remain in fixed position with respect to hoops 60, 62 include having threads pass through the braided cable as well as the ends of panel 58 when the loops are formed. Alternatively, adhesives could be used to prevent slippage of panels 58. The rearward edge 104 of panel 58 is preferably about half the length of forward edge 102 or about two inches. The distance between forward edge 102 and rearward edge 104 as shown in FIG. 7 is preferably about 5 inches. Various other dimensions are also possible depending upon factors such as, for example, the anticipated speeds of towing, the size of the visual augmenter and the materials relied upon.

Figure 7C:
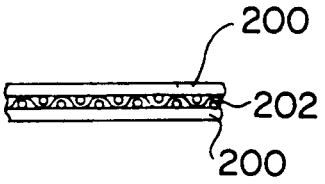

Panels 58 are contemplated as being made of a high strength fiber material. A vinyl nylon cloth referred to as "U.S. Government Part No.13227E0131:MIL-C-20696 Type II, Class 1" having a breaking strength equal to about 225 lb for one inch wide strip is contemplated for use in the present invention. FIG. 7C shows in cross-section a preferred embodiment of panel 58 wherein two vinyl layers 200 are layered about a cloth (or fiber) weave or mesh 202. This arrangement further ensures that panels 58 are of sufficient strength to handle the forces that develop during high speed runs. An alternative approach contemplated is to apply a vinyl coating on both sides of a layer of mesh or cloth.

Vented inflater 56 is attached to suspension lines 64 as best illustrated in FIG. 7. Suspension lines 64 have their ends looped about forward hoop 62 and box stitched to snugly fit about hoop 62 so as not to slide thereon. Additionally, various other means such as adhesives can be used to ensure no slippage of suspension lines 64 with respect to hoop 62. Visual augmenter 44 has at its forward edge a strip of material 204 which is connected to the individual strands forming the mesh pattern M. This strip of material is joined to aft cable 60 by lacing 206 which extends through the diamond mesh netting and around aft cable 60 and strip 204 in the open areas between adjacent panels 58. Lacing 206 is preferably formed of a waxed coated nylon material with the wax avoiding undue slippage while wrapping and knotting lacing 206 about both strip 204 and aft cable 60.

Figure 11:
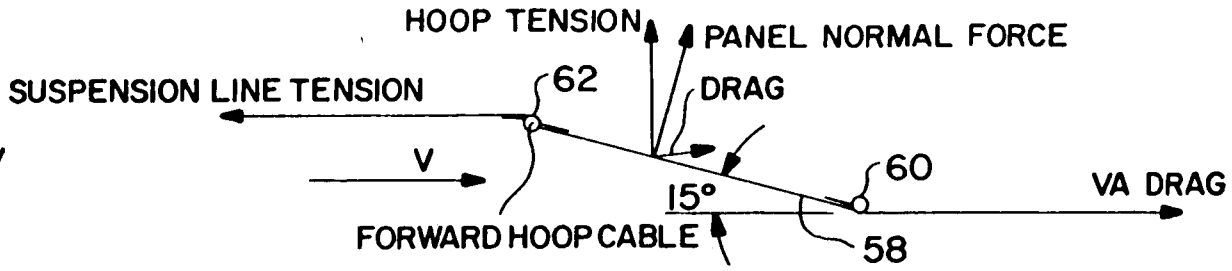
FIG. 11 shows a force diagram for the vented inflater panels while in a state of tension.

FIG. 11 provides a force diagram for panels 58 while in a tension state due to drag created by visual augmenter 44 and the tension placed on suspension lines 64. FIG. 11 also illustrates a 15 degree angle of attack for panel 58 shown in cross section. As can be seen in FIG. 11, panel 58 has its forward and rearward ends looped about hoops 60, 62. The forward and aft hoops 60, 62 are in tension resulting from the normal force created by the aerodynamic loading of panels 58. As a result of the larger diameter of forward hoop 62, in relation to the diameter of aft hoop 60, panels 58 are positioned within an approximate angle of attack of 15° relative to incoming air. The aerodynamic normal force of the panel can be broken down into two orthogonal components; the radial component (i.e. hoop tension) and the axial or drag component. The longitudinal tension required to maintain the preferred 5 inch separation distance between forward and aft hoops 60, 62 is provided by the opposing suspension line 64 tension acting forward and the visual augmenter 44 drag acting to the rear.

The spatial arrangement for panels 58 is configured to provide nearly equal size openings between each panel 58. With this arrangement, separation and the resulting turbulence of the local air stream over and around the panels is minimized. The spatial arrangement of the openings between the panels also provides a means for tailoring or optimizing the desired hoop tension over a wide variety of airspeed operations. The spatial arrangement of the panels 58 could vary in accordance with the specific requirements desired of the visual augmenter. A preferred embodiment has sixteen panels 58 spaced equally about forward and aft hoops 60,62.

Figure 12A:
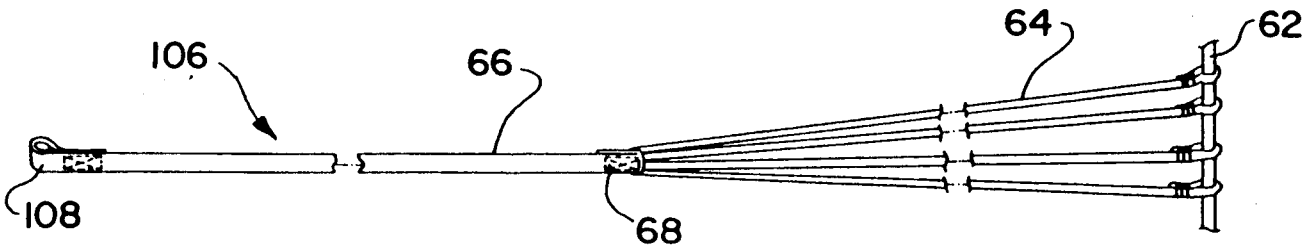
FIGS. 12A–12B show a cut-away view of the riser and suspension lines featured in FIG. 5.
Figure 12B:
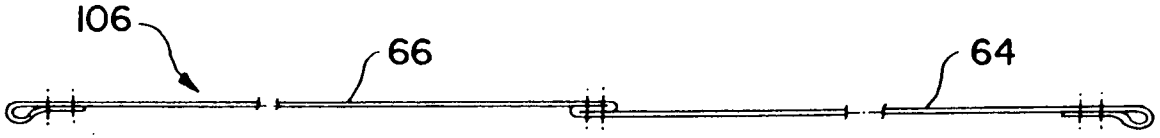

Tow harness 106 (shown in FIGS. 12A and 12B) is comprised of a plurality of riser lines 66 and suspension lines 64. In the embodiment shown in FIG. 2, four riser lines 66 are attached to frame structure at 72. Riser lines 66 are preferably about 5 feet in length and made from 1.75 inch wide U.S. Government nylon webbing designated MIL-W-4088 Type VIII, Class 2 with a described breaking strength of 3500 lbs. To fixation point 68 (FIGS. 12A and 12B), is attached four suspension lines 64 each preferably made from ½ inch commercial grade nylon webbing having a described breaking strength of 500 lb. The four suspension lines 64, are attached to one of the four riser lines 66 at fixation point 68. This attachment is shown in FIG. 12A and FIG. 12B to be made by use of a box stitch. Similarly, suspension lines 64 are connected to forward hoop 62 by wrapping the end of suspension line 64 about hoop 62 and using a box stitch to keep it in place. The forward end of riser line 66 also includes loop section 108 which is connected to cable 116 (FIG. 16) that attaches to one of the branches of frame 72.

Figure 8:
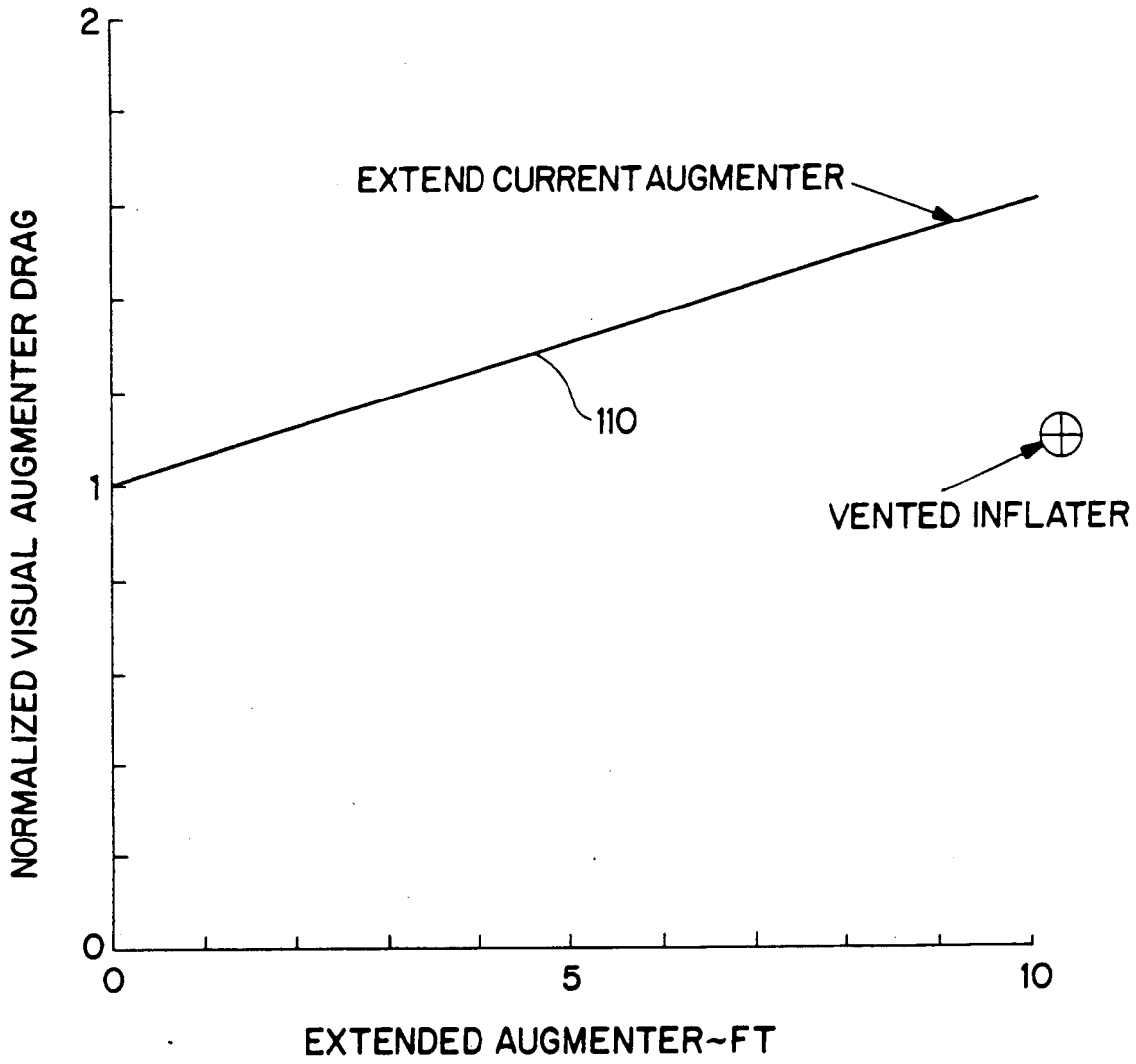
FIG. 8 is a graph which illustrates a calculated comparison of the drag experienced by an increased length visual augmenter with the drag of the present invention.

FIG. 8, which is based on calculations, depicts graphically the reduced drag made possible by the present invention. In FIG. 8 line 110 shows the increase in drag which would occur if a prior art visual augmenter such as that shown in FIG. 3 was increased an additional 10 feet. By utilization of suspension lines 64 and riser lines 66 each of about 5 feet in length, the entire length of the visual augmenter can be increased by about 10 feet. As set forth previously, the reliance on the combination of mesh netting M, vented inflater 56 and tow harness 106 allows for extension of the aerial gunnery target of the present invention while maintaining a reduced drag value. The aerial gunnery target of the present invention also enhances visual acuity of the target. The enhancement in visual acuity is made possible by the added length and, more importantly, the ability of the augmenter 44 to maintain a relatively uniform and condensed body which contrasts sharply against the environmental background. The vented inflater 56 assists in inflating visual augmenter 44 so as to maintain a generally cylindrical shape. Moreover, the passage of incoming air through vented inflater 56 and through the length of visual augmenter 44 helps prevent oscillation caused by external forces acting on the visual augmenter.

Figure 9:
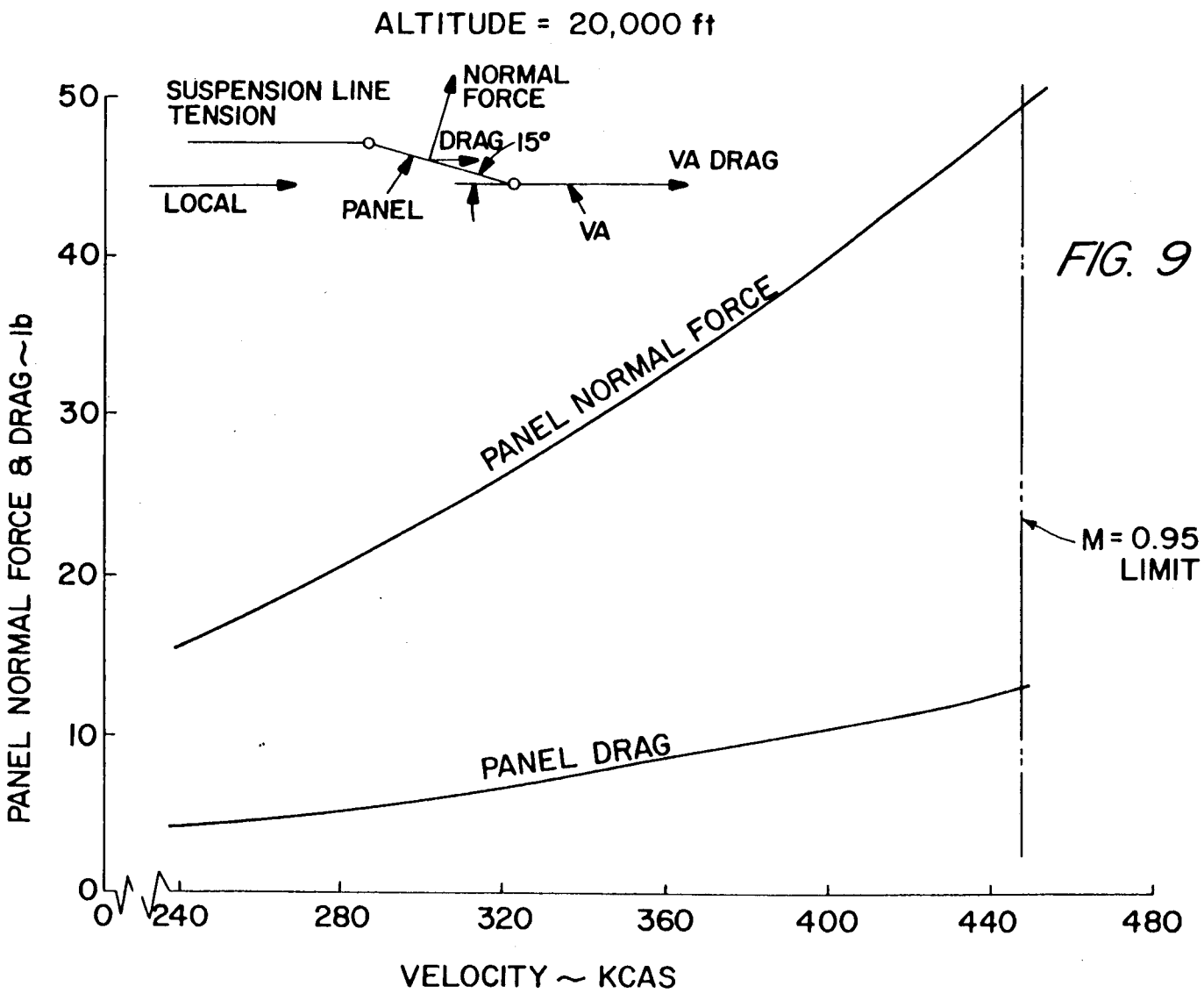
FIG. 9 shows an inflater panel's normal force and drag with respect to velocity.

FIG. 9 which is based on calculations depicts, graphically, the normal and drag forces which would be expected to develop in panels 58 in relation to the velocity of the towed visual augmenter. The limit value M shown in FIG. 9 is represented as 0.95 Mach or 448 KCAS [knots calibrated air speed]. FIG. 9 represents the normal and drag forces acting on panels 56 when at an attack angle of 15° . The material forming panels 56 as well as the manner of attachment to hoops 60, 62 must be capable of withstanding the forces shown in FIG. 9.

Figure 10:
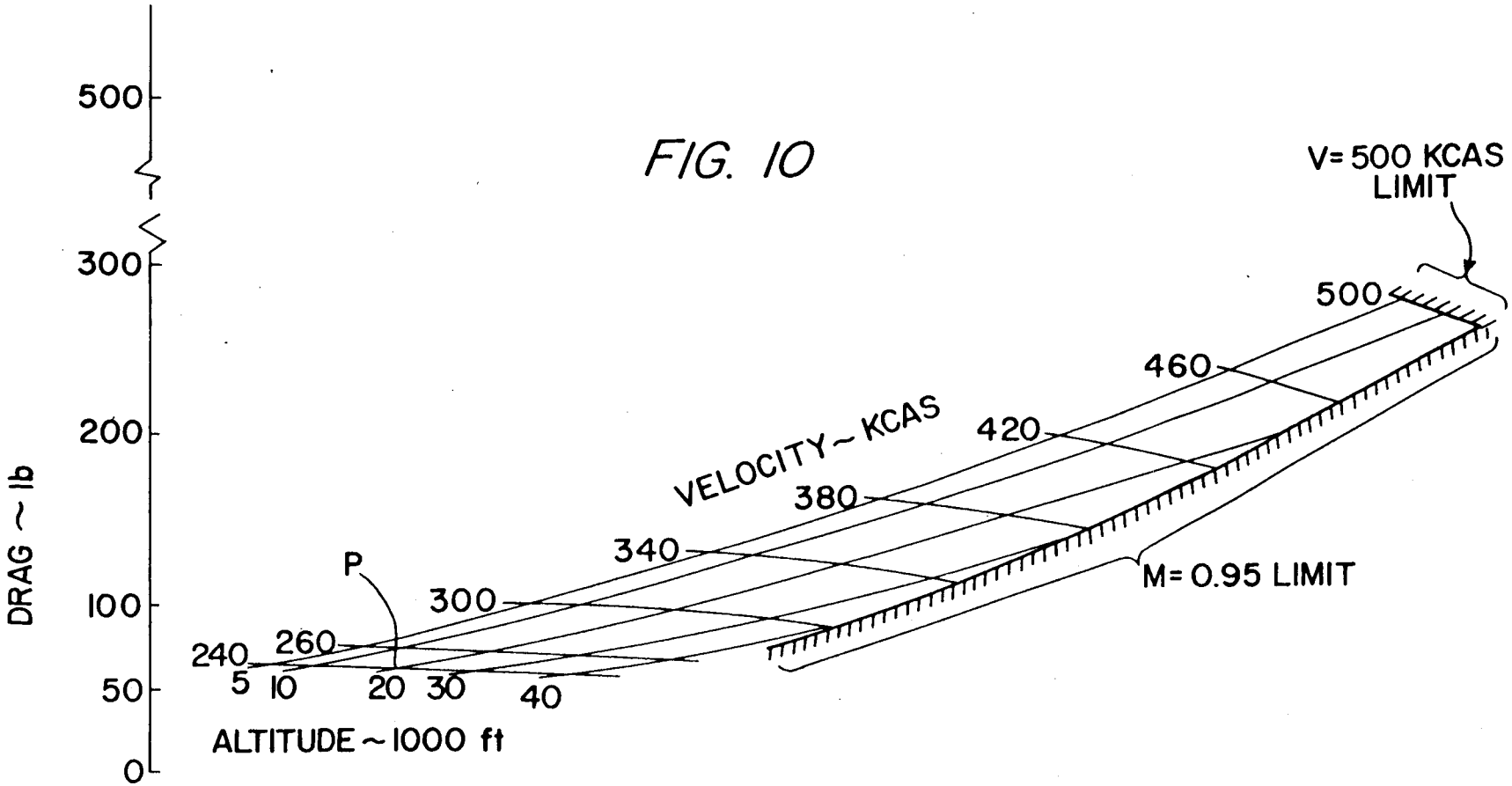
FIG. 10 shows the additional calculated drag increment resulting from the addition of a vented inflater.

FIG. 10 shows the calculated drag which can be expected due to the addition of vented inflater 56 to visual augmenter 44. FIG. 10 also reveals that the drag developed by including the vented inflater remains relatively low even up in the higher maximum speed regions.

Figure 15:
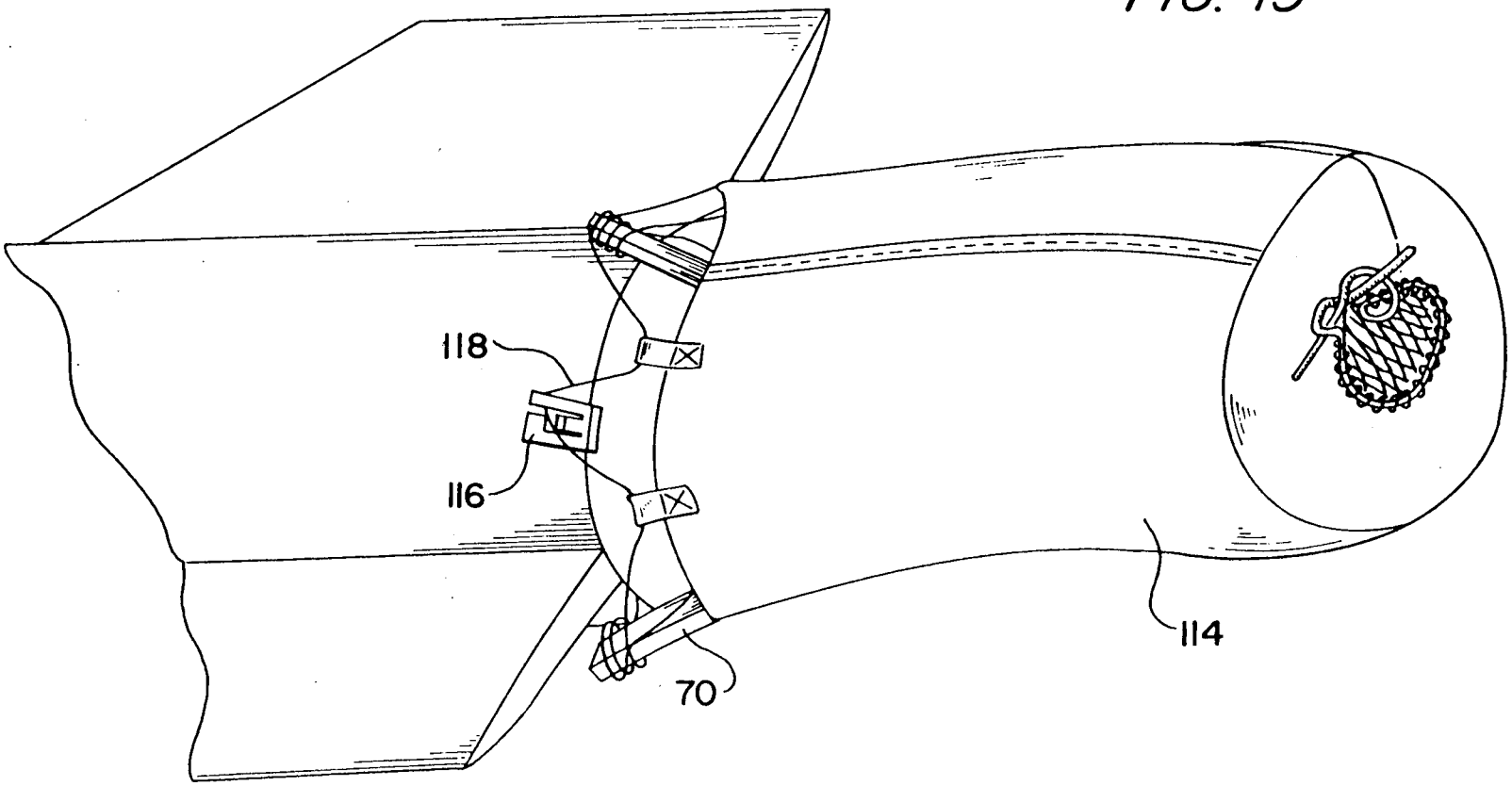
FIG. 15 shows the visual augmenter in a non-deployed state.

Returning to FIG. 2, reeling machine 82 is attached to the underside of one of the towing aircraft's wing. The reeling machine includes a releasable attachment device 112 that is capable of releasing forebody assembly 48 upon command of the pilot. In normal operation, visual augmenter 44 and towing harness 106 are contained within deployment bag 114 (FIG. 15) prior to deployment. While in flight above the predetermined target area, cutter mechanism 116 (FIG. 15) is activated (e.g. by an electronic signal) so as to cut the deployment line 118. Once deployment line is cut, branches 70 begin to extend outwardly and deployment bag 114 is drawn from its covering position. After bag 114 is drawn off by drag forces, the drag forces further act to deploy visual augmenter 44. Thereafter, forebody 48 is detached from attachment device 112 and reeled outwardly along tow line 80 (FIG. 2) until the visual augmenter 44 is the desired length away from the towing aircraft (e.g. 2,000 feet).

In operating an aerial gunnery target such as that of the present invention it is necessary to exclude the use of radar reflective type material within the scoring pattern envelope, i.e., visual augmenter 44 and the surrounding area within radar zone R2. If radar reflective material is used in the visual augmenter, vented inflater or in the towing harness it is highly probable that the unsteady highly cyclic vibrational type motion of the augmenter will result in false scoring outputs of the radar scoring system. The radar return of this motion can easily be misinterpreted by the scoring system as munition rounds passing through the scoring envelope. Accordingly, the present invention relies on a towing harness and visual augmenter formed of material which is not radar reflective. The foregoing discussion indicates that various materials such as nylon have proven suitable for the purposes of the present invention.

Referring again to FIG. 15, it is apparent that storage volume constraints also influence the design concept of a visual augmenter inflater. The flexible panel/hoop cable design of the vented inflater 56 provides a non-rigid highly flexible structure that can be folded or packed into virtually any shaped storage container or storage envelope so as to minimize storage volume requirements. The flexible riser and suspension lines are also easily folded up within storage container 114.

Following the desired target practice, the gunnery target is reeled in until forebody 48 becomes reattached to attachment device 112. Visual augmenter 44 and towing harness 106 are then released and allowed to drop to the ground or body of water below.

Figure 16:
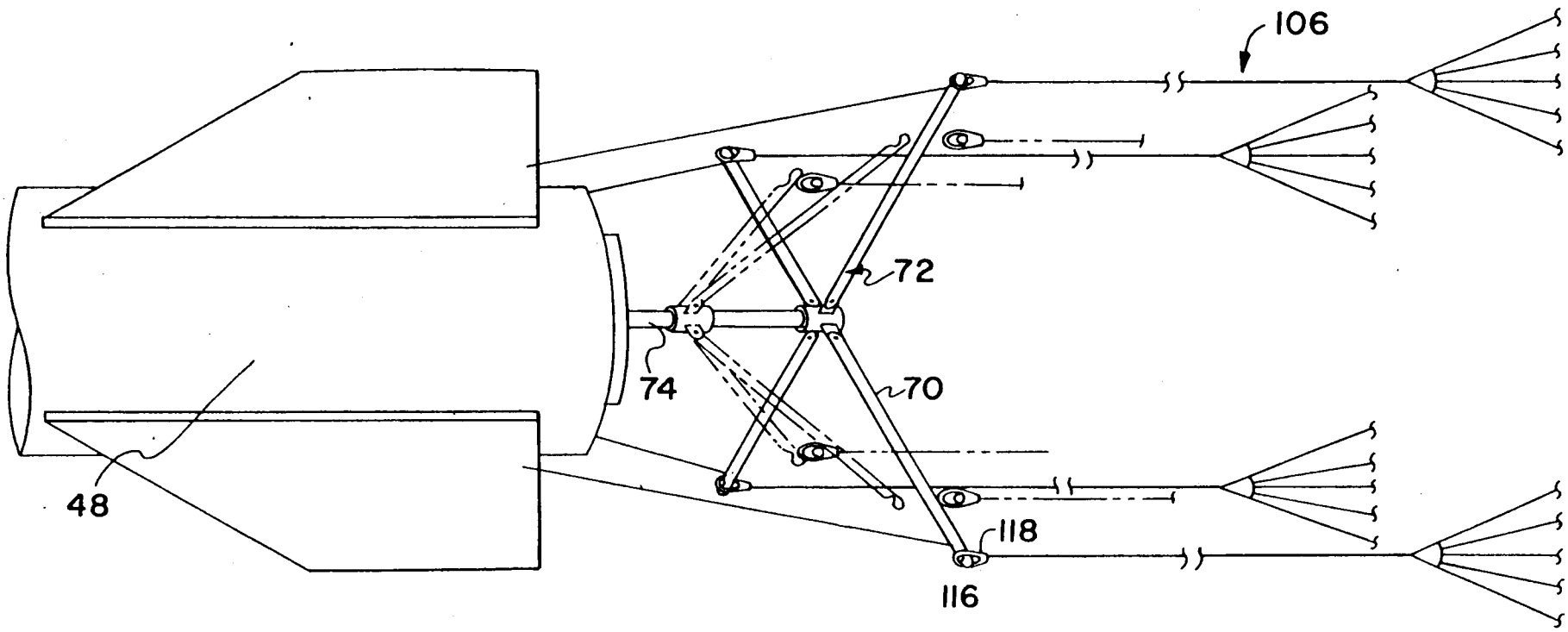
FIG. 16 shows a close-up view of the frame assembly positioned behind the forebody assembly.

FIG. 16 illustrates the manner in which towing harness 106 is disconnected from frame assembly 72 which is attached to shaft 74. To release tow harness 106, shaft 74 is drawn inwardly into the rear end of forebody assembly 48. This inward movement of shaft 74 causes branches 70 to collapse inwardly and in the rearward direction. Consequently, cable loops 116 and attached lead weights 118 are able to slide out of notches formed in branches 70 and become released as illustrated in dashed lines in FIG. 20. Visual augmenters 44 are then picked up upon landing on the ground or, if target practice is to take place over a body of water, visual augmenters 44 fall below the surface of the water and tend to remain entirely in contact with the underwater bottom surface.

Figure 17A:
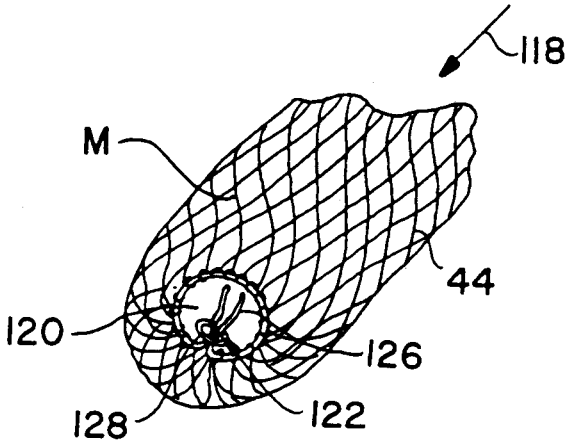
FIGS. 17A and 17B show the aft end of the visual augmenter cut-away from the remainder of the visual augmenter as well as the adjusting device positioned at the aft end.
Figure 17B:
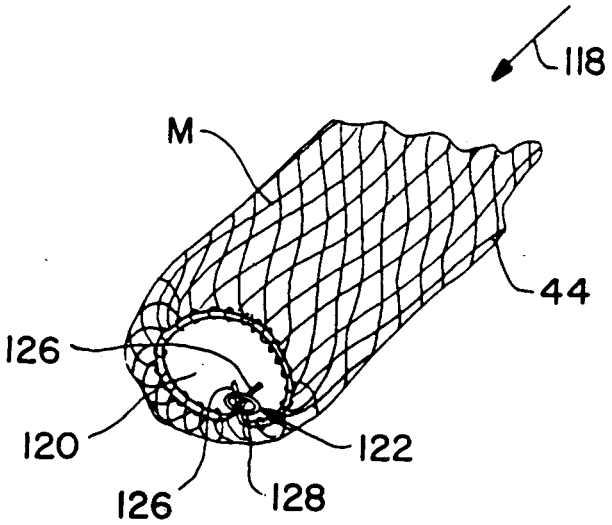

FIGS. 17A and 17B illustrate various sized openings at the aft end of visual augmenter 44. Air flowing through visual augmenter 44 in the direction of line 118 passes through opening 120. Drag can be increased by decreasing the size of opening 120. Hence, for slow speeds where it is desired to increase the drag of visual augmenter 44 so as to maintain proper positioning, the aft end opening 120 can be decreased in size as shown in FIG. 17A. Variations in the size of aft opening 120 are made possible by adjustment device 122 which includes a nylon cord 126 (or the like) passing within a sleeve provided at the aft end of mesh netting M. Cord 126 is shown as having two free ends which pass through adjustment clip 128. By drawing the free ends of cord 126 away from adjustment clip 128, the aft end opening 120 is made smaller.

Figure 13:
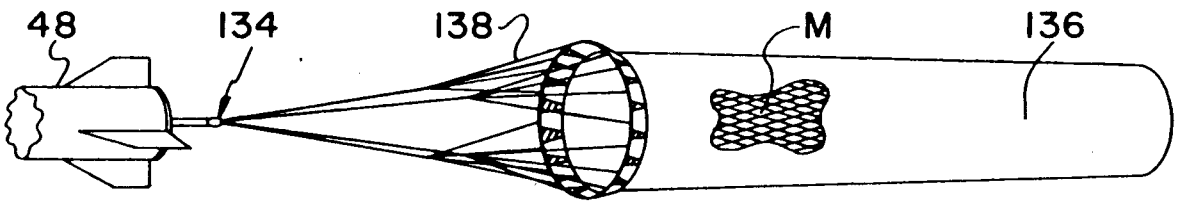
FIG. 13 shows an alternate embodiment of the present invention which utilizes a swivel connection between the forebody assembly and the riser lines.
Figure 14:
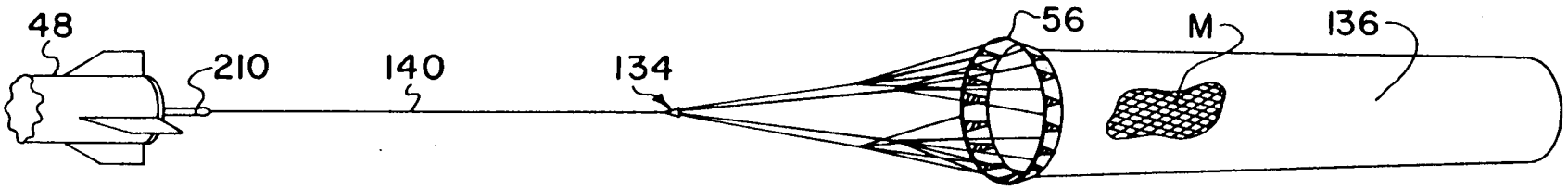
FIG. 14 shows another embodiment of the present invention which has a swivel connection and a drag line connecting the forebody assembly to the riser lines.

FIGS. 13 and 14 show two alternate embodiments of the present invention. In FIG. 13, swivel connector 134 allows for visual augmenter 136 and extension device 138 to freely rotate with respect to forebody assembly 48. Other than the swivel connector between forebody assembly 48 and extension device 138, all other features are similar to that of the visual augmenter illustrated in FIG. 2. FIG. 14 is essentially the same as FIG. 13 except for the addition of drag line 140 between forebody assembly 48 and swivel connector 134. In utilizing the embodiments of FIGS. 13 and 14, detachment of visual augmenter 44 is made simple in that all that is required is a release of the swivel connector 134 or, alternatively, connection device 210 shown in FIG. 14.

As can be seen, the addition of vented inflater at the forefront of the visual augmenter provides a great deal of freedom in determining how the visual augmenter is to be attached to a forebody assembly or, alternatively, directly to the end of a tow cable. The vented inflater makes unnecessary the use of frame structures to maintain the front opening of a visual augmenter in an open state. Moreover, the vented inflater of the present invention allows for non-rigid and nonradar reflective material to provide the required opening at the front of a visual augmenter.

Although the preferred embodiments of the present invention have been described with reference to the accompanying drawings, many modifications and changes may be effected by those skilled in the art without departing from the scope and spirit of the invention as appended hereinafter.

What is claimed is:

1. An aerial gunnery target, comprising:

a forebody assembly;

a visual augmenter formed of mesh netting; said mesh netting having interconnected strands which are joined together at points of intersection by knitting; and attachment means for attaching said visual augmenter to said forebody assembly.

2. A target as recited in claim 1, wherein said visual augmenter, when deployed, assumes a generally cylindrical shape with an open forward end and a partially closed aft end.

3. A target as recited in claim 2, wherein the axial length of the cylindrical shaped augmenter is about 16 feet.

4. A target as recited in claim 2, wherein said cylindrical shaped augmenter has an external diameter of about 30 inches.

5. A target as recited in claim 1, wherein said interconnected strands intersect one another to form diamond shaped openings.

6. A target as recited in claim 5, wherein said interconnected strands are formed of a plurality of knitted threads and said interconnected strands are joined together at a point of intersection by knitting the knitted threads of one interconnected strand to the knitted threads of another interconnected strand.

7. A target as recited in claim 6, wherein said interconnected strands are formed of about 1890 denier nylon thread.

8. A target as recited in claim 6, wherein said interconnected strands form diamond shaped openings having a longitudinal apex-to-apex length, when in storage condition, of between about 1.22 to 1.28 inches.

9. A target as recited in claim 8, wherein said interconnected strands form diamond shaped opening having a lateral apex-to-apex length, when in storage condition, of about $\frac{1}{3}$ of an inch.

10. A target as recited in claim 6, wherein said knitted threads are formed of nylon.

11. A target as recited in claim 1, wherein said forebody assembly includes an elongated body with a conical front end and a finned rear end, said forebody assembly further including means for securing said forebody assembly to a tow line.

12. An aerial gunnery target, comprising:

a visual augmenter;

means for securing said visual augmenter to a towing device, said means for securing including a vented inflater, said vented inflater having a first and a second hoop longitudinally displaced from one another with flexible connectors extending between said hoops, and said second hoop connected to the forward end of said visual augmenter.

13. A target as recited in claim 12, wherein said flexible connectors are panels of woven material arranged between said hoops such that an air vent is formed between adjacent panels.

14. A target as recited in claim 13, wherein said first hoop is larger in diameter than said second hoop such that each panel, when in a tensioned state, forms an angle of attack with respect to incoming air of about 15 degrees.

15. A target as recited in claim 14, wherein the diameter of said first hoop is larger than the diameter of said second hoop by a ratio of about 1.087.

16. A target as recited in claim 15, wherein each panel, when in a tensioned state, extends about 5 inches between said first and second hoops.

17. A target as recited in claim 13, wherein said panels are formed of a lamination of vinyl and nylon cloth.

18. A target as recited in claim 17, wherein said panels have a forward and a rearward edge in attachment with respective ones of said hoops such that the forward edge is about twice the width of the rearward edge.

19. An aerial gunnery target, comprising:

a forebody assembly;

a vented inflater having a longitudinally spaced forward and rearward hoop and means to interconnect said longitudinally spaced forward and rearward hoops;

a visual augmenter having a front portion attached to said vented inflater; and attachment means for attaching said vented inflater to said forebody assembly, said attachment means comprising a frame secured to said forebody assembly and having branches extending axially from a common locus, risers extending rearwardly off and attached to a free end of said branches, and sets of suspension lines with each set including a plurality of suspension lines and each set of suspension lines being attached to a respective one of said risers, and said suspension lines extending divergently outward for connection to said vented inflater.

20. A target as recited in claim 19, wherein said means to interconnect said longitudinally spaced forward and rearward hoop includes a plurality of flexible panels positioned between said forward and rearward hoops, said panels being spaced uniformly from one another about said hoops so as to form a plurality of air vents, said suspension lines each having a rearward end attached to said forward hoop between adjacent panels.

21. A target as recited in claim 20, wherein said risers, suspension lines and hoops are formed of non-metallic material.

22. A target as recited in claim 21, wherein said risers are about 5 feet in length.

23. A target, as recited in claim 22, wherein said suspension lines are about 5 feet in length.

24. An aerial gunnery target, comprising:

a forebody assembly;

a vented inflater having a longitudinally spaced forward and rearward hoop and interconnection means to interconnect said longitudinally spaced forward and rearward hoops;

a visual augmenter attached to said vented inflater; and attachment means for attaching said vented inflater to said forebody assembly, and said attachment means comprising:

a connection device secured to said forebody assembly;

risers each having a forward end in attachment with said connection device; and sets of suspension lines with each set including a plurality of suspension lines and each set of suspension lines being attached to a respective one of said risers, and said suspension lines extending divergently out away from the rearward end of said risers and being connected to said vented inflater.

25. A target as recited in claim 24, wherein said interconnection means has a plurality of flexible panels positioned between said forward and rearward hoops, said panels being spaced uniformly from one another about said hoops so as to form a plurality of air vents, and said suspension lines each having a rearward end attached to said forward hoop between adjacent panels, and said rearward hoop being connected to said visual augmenter.

26. A target as recited in claim 24, wherein said attachment device includes a drag line having a forward end connected to the rear end of said forebody assembly and a rearward end attached to said connection device so as to increase the distance between said forebody assembly and said visual augmenter.

27. A target as recited in claim 26, wherein said connection device is a swivel connector.

28. An aerial gunnery target, comprising:

a forebody assembly;

a visual augmenter;

a vented inflater connected to said visual augmenter and said forebody assembly, said vented inflater having a forward hoop, a rearward hoop, and a plurality of flexible panels, with each of said panels having a forward end secured to said forward hoop and a rearward end secured to said rearward hoop, said panels being positioned in series about said hoops so as to provide air vents therebetween.

29. A target as recited in claim 28, wherein said forward hoop is of a diameter which is greater than said rearward hoop.

30. A target as recited in claim 29, wherein the diameter of said forward hoop is greater than said rearward hoop by about the ratio of 1.087.

31. A target as recited in claim 30, wherein each of said flexible panels, when in a tensioned state between said forward and rearward hoops, has an angle of attack with respect to incoming air of between about 12 to 18 degrees.

32. A target as recited in claim 31, wherein said angle of attack is about 15 degrees.

33. A target as recited in claim 28, wherein said panels are formed of a vinyl material.

34. A target as recited in claim 33, wherein said panels are formed of a laminate including two outer vinyl layers and an inner layer of woven nylon material.

35. A target as recited in claim 28, further comprising attachment means connecting said visual augmenter to said forebody assembly, said attachment means being about 10 feet in length.

36. A target as recited in claim 28, wherein said visual augmenter is formed of a mesh netting which when deployed is generally cylindrical in shape and said mesh netting having diamond shaped mesh openings.

37. A visual augmenter for use in an aerial gunnery target comprised of an elongated visual body formed of a mesh netting with said visual body having an open forward end and an open aft end and said visual body being formed of a plurality of intersecting strands which are joined together at their points of intersection by knitting one strand with respect to another strand.

38. A visual augmenter as recited in claim 37, wherein the open aft end includes adjustment means for varying the size of the opening in the aft end.

39. A visual augmenter as recited in claim 38, wherein said adjustment means includes a draw cord.

40. A visual augmenter as recited in claim 37, wherein said interconnected strands intersect one another to form diamond shaped openings with the diamond shaped openings having an apex-to-apex length, when in a storage condition, which extends in the direction of said elongated body between a range of about 1.22 to 1.28 inches.

41. A visual augmenter as recited in claim 37, wherein said interconnected strands are formed of a plurality of knitted threads and said interconnected strands are joined together at a point of intersection by knitting the knitted threads of one interconnected strand to the knitted threads of another interconnected strand.

42. A visual augmenter as recited in claim 41, wherein said interconnected strands are formed of 1890 denier nylon threads.

43. A visual augmenter system for an aerial gunnery target, comprising:

a vented inflater, said vented inflater having a first and a second hoop longitudinally displaced from one another and flexible connectors extending between said hoops; and a visual augmenter connected to said vented inflater.

44. A visual augmenter system as recited in claim 43, wherein said flexible connectors are panels of flexible material arranged between said hoops such that an air vent is formed between adjacent panels.

45. A visual augmenter system as recited in claim 44, wherein said first hoop is larger in diameter than said second hoop such that each panel, when in a tensioned state, forms an angle of attack with respect to incoming air of about 15 degrees.

46. A visual augmenter system as recited in claim 45, wherein the diameter of said first hoop is larger than the diameter of said second hoop by ratio of about 1.087.

47. A visual augmenter system as recited in claim 46, wherein said hoops are formed of a flexible vinyl material.

48. A visual augmenter system as recited in claim 46, wherein each panel, when in a tensioned state, extends about 5 inches between said first and second hoops.

49. A visual augmenter system for an aerial gunnery target, comprising:

a visual augmenter having an elongated body and an open forward and aft end; and a vented inflater attached to the forward end of said visual augmenter, said vented inflater including first and second support means and a plurality of panels positioned between said first and second support means, said panels being spaced about said flexible support means so as to provide air vents between said panels, and said support means being dimensioned so as to place said panels at an incline.

50. A visual augmenter system as recited in claim 49, wherein said first and second support means are ring shaped hoops longitudinally spaced forward and aft at the forefront of said visual augmenter and said forward hoop defining a greater internal diameter than said aft hoop.

51. A visual augmenter system as recited in claim 50, wherein said forward hoop has an internal diameter which is greater than that of said aft hoop by a ratio of about 1.087.

52. A visual augmenter system as recited in claim 50, wherein said forward hoop has an internal diameter of about 32.6 inches and said aft hoop has an internal diameter of about 30.0 inches.

53. A visual augmenter system as recited in claim 50, wherein said forward and aft hoops are formed of flexible nylon cable having a diameter within the range of about 3/16 to ¼ of an inch.

54. A visual augmenter system as recited in claim 53, wherein said panels are in the form of truncated triangles and are comprised of nylon cloth with vinyl coating.

55. An aerial gunnery target, comprising:

a visual augmenter with a forward end and a rearward end; and securement means for securing said visual augmenter to a towing device, said securement means including a vented inflater, said vented inflater having a forward hoop and a rearward hoop longitudinally displaced from one another and connecting means extending between said hoops, and said rearward hoop being connected to the forward end of said visual augmenter.

56. A target as recited in claim 55, wherein said connecting means includes a plurality of flexible connectors arranged between said hoops such that an air vent is formed between adjacent flexible connectors.

57. A target as recited in claim 56, wherein said forward hoop is larger in diameter than said rearward hoop and said flexible connectors are panels.

58. An aerial gunnery target, comprising:

a visual augmenter having a forward and a rearward end;

securement means for securing said visual augmenter to a towing device, said securement means including a vented inflater connected to the forward end of said visual augmenter, said vented inflater formed of a flexible material and having a plurality of air vent openings formed therein, and said vented inflater, when in an inflated state, being inclined with respect to incoming air such that the forward end of said visual augmenter is placed in a tensioned state.

* * * * *